US005320268A

United States Patent [19]

Shkolnikov et al.

[11] Patent Number: 5,320,268

[45] Date of Patent: Jun. 14, 1994

[54] POWERED DIMPLE-FORMING AND FASTENER-DRIVING TOOL

[75] Inventors: Yury Shkolnikov, Glenview; Mohamed Wagdy, Arlington Heights, both of Ill.

[73] Assignee: Illinois Tool Works Inc., Glenview, Ill.

[21] Appl. No.: 46,417

[22] Filed: Apr. 13, 1993

[51] Int. Cl.[5] ..... B25C 1/18

[52] U.S. Cl. ..... 227/66; 227/8; 227/148

[58] Field of Search ..... 227/66, 8, 148, 130, 227/10

[56] References Cited

U.S. PATENT DOCUMENTS

| | | | |
|---|---|---|---|
| Re. 32,452 | 7/1987 | Nikolich | 123/46 SC |
| 2,918,675 | 12/1959 | Smith | 1/44.4 |
| 3,027,560 | 4/1962 | Nelson | 1/49 |
| 3,040,327 | 6/1962 | Michel | 1/107 |
| 3,281,046 | 10/1966 | Boulay | 227/148 |
| 3,774,293 | 11/1973 | Golsch | 29/432.1 |
| 4,341,336 | 7/1982 | Smith | 227/66 |
| 4,566,619 | 1/1986 | Kleinholz | 227/8 |
| 4,573,623 | 3/1986 | Sexton, Jr. et al. | 227/66 |
| 4,610,381 | 9/1986 | Kramer et al. | 227/7 |
| 4,611,739 | 9/1986 | Rowton | 227/66 |
| 4,666,074 | 5/1987 | MacDonald | 227/66 |
| 4,775,089 | 10/1988 | MacDonald | 227/2 |
| 4,778,094 | 10/1988 | Fishback | 227/66 |
| 4,867,366 | 9/1989 | Kleinholz | 227/66 |
| 5,197,646 | 3/1993 | Nikolich | 227/8 |
| 5,205,457 | 4/1993 | Blomquist, Jr. | 227/66 |
| 5,222,646 | 6/1993 | Mukoyama | 227/66 |

*Primary Examiner*—Rinaldi Rada

*Attorney, Agent, or Firm*—Illinois Tool Works Inc.

[57] ABSTRACT

In a powered tool for dimpling a drywall panel and driving a drywall nail through such panel, into a substrate, a dimpler mounted to a nosepiece of the tool so as to be axially movable over a limited range has an annular portion disposed axially beyond the nosepiece. The tool includes a piston and a driving blade joined to the piston and arranged for driving a drywall nail through the nosepiece and the annular portion, for engaging the annular portion near a distal end of the driving blade, and for driving the dimpler outwardly when the piston is impelled from a retracted position toward an advanced position. The annular portion has a frusto-conical bore. The driving blade has a frusto-conical tip fitting thereinto. A workpiece-contacting shoe is adjustable between a right-angled position relative to the drywall panel and an acute-angled position.

10 Claims, 5 Drawing Sheets

12
D
16
28
210
170
160
164
166
180
200
202
192
134
28
194
74
72
70
120
118
100
34
36
190
110
114
116
106
112
80
82
152
150
90
168
74
76
118
104
102
120
100
132
130

POWERED DIMPLE-FORMING AND FASTENER-DRIVING TOOL

TECHNICAL FIELD OF THE INVENTION

This invention pertains to a powered tool, for forming a dimple in a workpiece, such as a drywall panel, and for driving an elongate fastener through the workpiece where formed with the dimple, into a substrate. This invention enables the tool effectively to employ a dimpler having a low mass operable with low impact forces.

BACKGROUND OF THE INVENTION

Pneumatically powered tools are used widely for forming dimples in workpieces, such as drywall panels, and for driving drywall nails or other elongate fasteners through such workpieces where formed with such dimples, into wooden studs or other substrates. Such tools are exemplified in Golsch U.S. Pat. No. 3,774,293 and Fishback U.S. Pat. No. 4,778,094.

Typically, such a tool employs a driving mechanism including a piston and a driving blade and having a high mass, along with a dimpler having a high mass and being shaped to form a dimple in the workpiece when struck by the driving mechanism. The dimple is a shallow recess, into which a nail is driven so that its head is countersunk. The dimple can be then filled with drywall finishing material, which conceals the nail head.

As exemplified in the patents noted above, it has been usual to arrange the driving mechanism and the dimpler so that the driving mechanism strikes the dimpler at a considerable distance from the workpiece.

In such a tool, as known heretofore, it is difficult accurately to control the depth of penetration of the dimpler into the workpiece because of the impact between the driving mechanism and the dimpler. The impulse of the impact therebetween can be calculated as $$I = \frac{2Vm_1m_2}{m_1 + m_2}$$

where V is the initial velocity of the driving mechanism before impact, $m_1$ is the mass of the driver mechanism, and $m_2$ is the mass of the dimpler.

Desirably, since it is difficult to reduce the mass of the driving mechanism, the mass of the dimpler should be low so as to reduce the impulse of the impact between the driving mechanism and the dimpler.

SUMMARY OF THE INVENTION

This invention provides an improved tool for forming a dimple in a workpiece, such as a drywall panel, and for driving an elongate fastener, such as a drywall nail, through the workpiece into a substrate. The tool may be pneumatically powered or combustion-powered.

The invention provides several advantages over the prior art. For example, the structural interrelationship between the driver and the dimpler is simple and effective in requiring a lower impact force on the dimpler to accomplish its work. More specifically, the end of the driver is configured to engage the dimpler adjacent to the end which dimples the wall. This relationship permits operation with low impact forces. This is contrasted with the prior art wherein the dimpler is struck and driven on the opposite or upper end, such that the driving forces must be transmitted through the entire length of the dimpler. The result may be higher impact forces with the possibility that the dimpler will tear the paper surface of the drywall.

In a preferred embodiment of the interface between the driver and the dimpler, the end of the driver has a frustro-conical portion which engages a complimentary-shaped section at the end of the dimpler which engages the wall.

Generally, the improved tool includes a housing structure defining a chamber having an axis, a nosepiece extending axially from the housing structure, a dimpler mounted operatively to the nosepiece, and a driving mechanism, which includes a piston and a driving blade. The nosepiece has a bore coaxial with the chamber, with which the bore communicates.

The dimpler is mounted to the nosepiece so as to be outwardly and inwardly movable along the axis, over a limited range of relative movement between the dimpler and the nosepiece. The dimpler has an annular portion defining a bore, which is coaxial with the nosepiece bore and which includes an outlet. The annular portion is disposed axially beyond the nosepiece. The dimpler may be outwardly biased along the axis.

Preferably, the annular portion of the dimpler has a socket having a frusto-conical wall, which extends to the outlet of the annular portion. Preferably, moreover, the driving blade has a frusto-conical tip conforming generally to the frusto-conical wall. The tip of the driving blade fits into the socket to drive the dimpler outwardly when the piston and the driving blade move from the retracted position toward the advanced position.

The piston is movable axially within the chamber between a retracted position and an advanced position. The driving blade, which extends axially through the housing structure, has a proximal end and a distal end and is joined to the piston at the proximal end so as to be conjointly movable with the piston between the retracted and advanced positions.

The driving mechanism is operable for driving an elongate fastener through the bore of the nosepiece and through the bore of the annular portion of the dimpler, for engaging the annular portion of the dimpler near the distal end of the driving blade, and for driving the dimpler outwardly when the piston is moved from the retracted position toward the advanced position. Preferably, the tool includes a resilient bumper for limiting outward movement of the dimpler along the axis.

The tool further may include a workpiece-contacting shoe, which is movable axially between a tool-disabling position and a tool-enabling position and which is biased toward the tool-enabling position, for disabling the tool unless the shoe is moved to the tool-enabling position. A resilient bumper, as noted above, may be advantageously mounted to the shoe.

In a preferred arrangement, the workpiece-contacting shoe has two workpiece-contacting surfaces, namely a first surface and a second surface. The first surface defines a plane oriented at a right angle relative to the axis. The second surface defines a plane oriented at a relatively large, acute angle relative to the axis and at a relatively small, acute angle relative to the plane defined by the first surface.

In the preferred arrangement, a tip is mounted adjustably to an extending portion of the shoe and is adjustable between a first portion and a second portion. The tip has a workpiece-contacting surface coplanar with the first workpiece-contacting surface of the shoe in the first position of the tip.

Preferably, the tip is mounted to the extending portion so as to be rotatably adjustable between the first and second positions. Optimally, the tip has two workpiece-contacting surfaces, namely the surface noted in the preceding paragraph and a workpiece-contacting surface coplanar with the second workpiece-contacting surface of the shoe in the second position of the tip.

This invention may be advantageously embodied in a combustion-powered, fastener-driving tool, as described below. However, this invention is not limited to a combustion-powered, fastener-driving tool but may be alternatively embodied in a pneumatically powered, fastener-driving tool.

These and other objects, features, and advantages of this invention are evident from the following description of a preferred embodiment of this invention with reference to the accompanying drawings.

DETAILED DESCRIPTION OF PREFERRED EMBODIMENT

Figure 1:
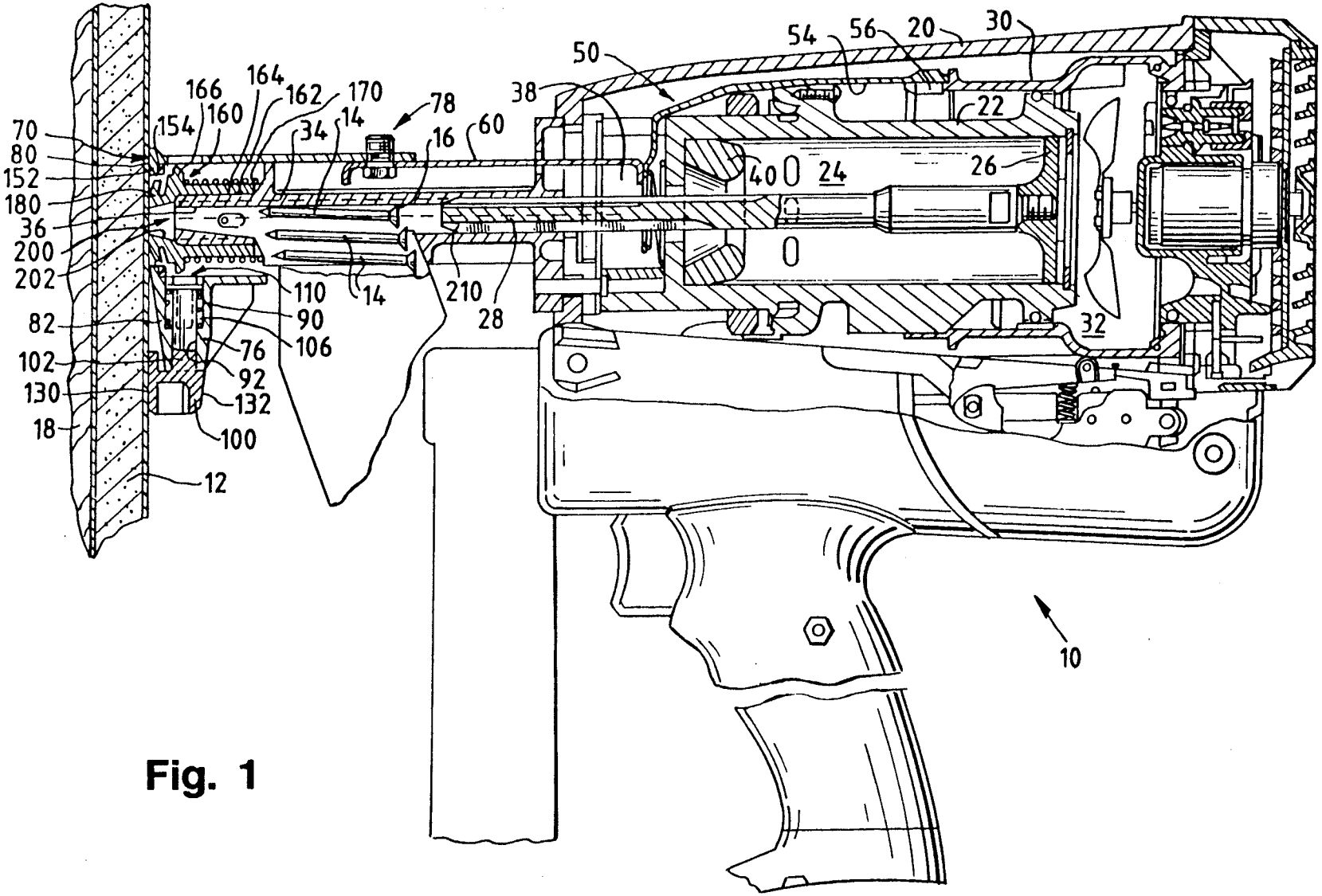
FIG. 1 is a view of a combustion-driven, dimple-forming and fastener-driving tool embodying this invention, as viewed substantially in longitudinal cross-section. A drywall panel and a wooden stud serving as a substrate are shown fragmentarily. The tool is shown in a preferred orientation, in which a tool axis defines a right angle relative to the drywall panel, before a fastener is driven and a dimple is formed.

As shown, a combustion-powered tool 10 for forming a dimple D in a drywall panel 12 and for driving a drywall nail 14 having a circular head 16 through the drywall panel 12 where formed with the dimple D, into a wooden stud 18, constitutes a preferred embodiment of this invention. The drywall nail 14 is one of a series of similar nails collated by known means (not shown) such as a polymeric strip, a paper tape adhering to such nails, or wires welded to the collated nails and being fed successively into the tool 10.

The tool 10 comprises a housing structure 20, within which a cylinder body 22 is mounted fixedly. The cylinder body 22 defines a piston chamber 24 and also defines a tool axis. A piston 26 is mounted operatively in the piston chamber 24. The piston 26 is arranged to drive a driving blade 28 extending axially from the cylinder body 22. The piston 26 and the driving blade 28 are joined integrally at a proximal end of the driving blade 28.

A valve sleeve 30 is mounted in axially movable relation to the cylinder body 22. The cylinder body 22 and the valve sleeve 30 define a combustion chamber 32. The valve sleeve 30 is moveable axially, along the cylinder body 22, so as to open and close the combustion chamber 32. A nosepiece 34 is mounted fixedly to the housing structure 20, in axially spaced relation to the cylinder body 22. The nosepiece 34 has a bore 36 coaxial with the piston chamber 24. A lower chamber 38 is defined between the cylinder body 22 and the nosepiece 34. A resilient bumper 40 is disposed within the cylinder body 22 for arresting the piston 26.

An actuating structure 50 is provided for closing the combustion chamber 32 when a workpiece-contacting shoe to be later described is pressed firmly against the drywall panel 12. The actuating structure 50 includes plural (e.g. four) arms 54 (one shown) connected to the valve sleeve 30 by fasteners 56 (one shown) so as to be conjointly movable with the valve sleeve 30. The arms 54 are connected to each other by an annular member 58 disposed within the lower chamber 38 and across the tool axis. The arms 54 are shaped so as to extend outwardly from the lower chamber 38 and upwardly along the cylinder body 22.

A coiled spring 52, which is disposed within the lower chamber 38, is compressible between the cylinder body 22 and the annular member 58 of the actuating structure 50, so as to bias the valve sleeve 30, via such structure 50, to a tool-disabling position, in which the combustion chamber 32 is opened. The actuating structure 50 also includes a link 60 extending axially from the annular member 58. The lower chamber 38 provides axial clearance, to permit a limited range of axial movement of the arms 54 and the annular member 58 relative to the cylinder body 22, the nosepiece 34, and the housing structure 20 between the tool-disabling position and a tool-enabling position, in which the combustion chamber 32 is closed. The tool 10 is disabled when the combustion chamber 32 is not closed. The tool 10 comprised a manually actuatable trigger (not shown) which must be also actuated, after the combustion chamber 32 has been closed to enable the tool 10, so as to operate the tool 10 for driving a fastener.

As described in the preceding four paragraphs, except for its novel features disclosed herein, the tool 10 is similar to combustion-powered, fastener-driving tools available commercially from ITW Paslode (a unit of Illinois Tool Works Inc.) of Lincolnshire, Ill., under its IMPULSE trademark. Such combustion-powered tools are exemplified in Nikolich U.S. Pat. No. Re. 32,452 and in Nikolich U.S. Pat. No. 5,197,646, the disclosures of which patents are incorporated herein by reference. Thus, except as illustrated and described herein, other structural and functional details of the tool 10 can be readily supplied by persons having ordinary skill in the art and are outside the scope of this invention.

Figures 5, 6, 7, 8:
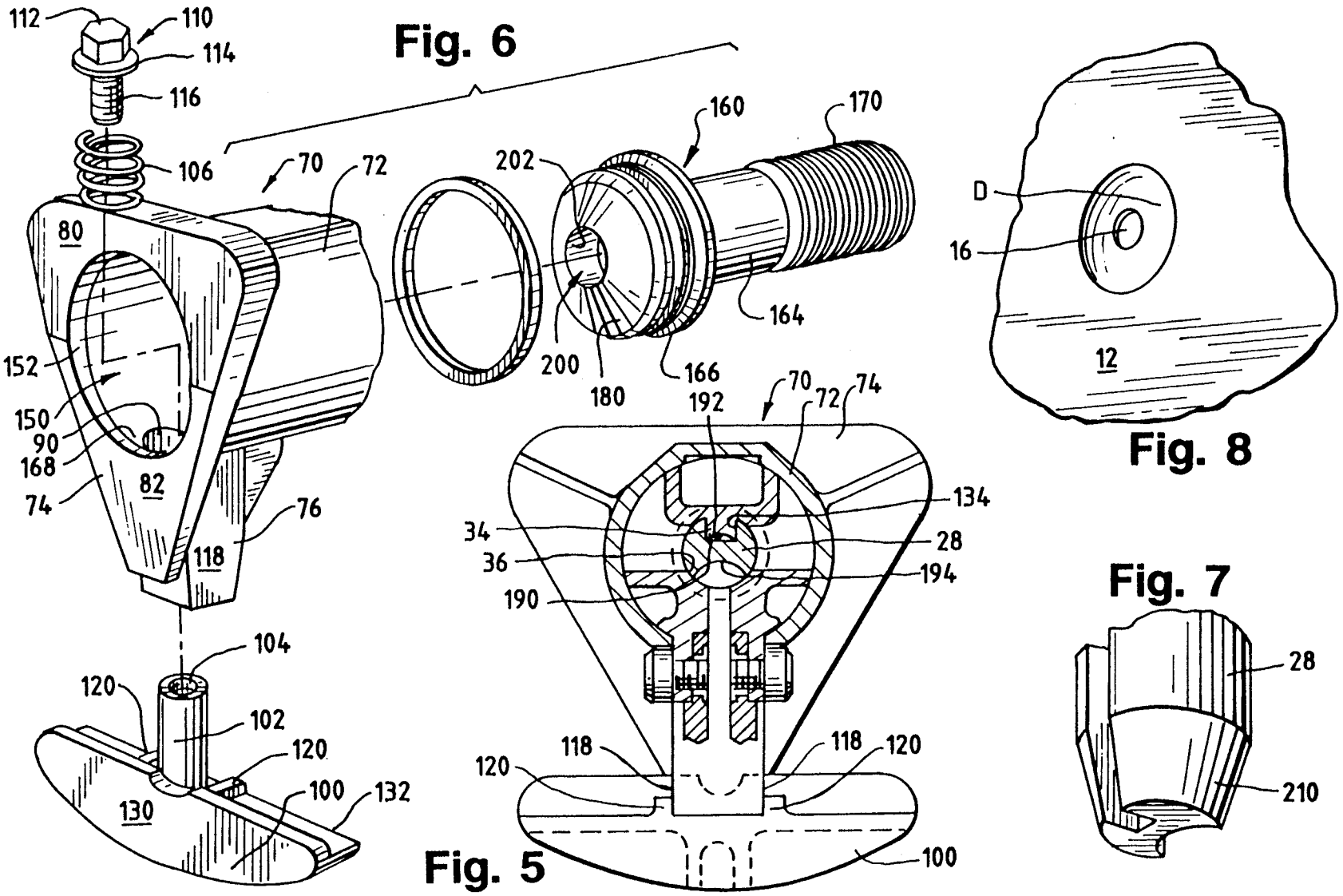
FIG. 5 is a sectional view taken along line 5—5 of FIG. 3, in a direction indicated by arrows.
FIG. 6 is an exploded, perspective view of certain parts of the tool.
FIG. 7 is a fragmentary, perspective view of the distal end of the driving blade of the tool.
FIG. 8 is a fragmentary, perspective detail of the drywall panel, after a fastener has been driven and a dimple has been formed, and before drywall finishing material (not shown) is applied to conceal the fastener and to fill the dimple.

As shown in FIG. 6 and other views, a workpiece-contacting shoe 70 includes a sleeve portion 72, a plate portion 74, and a radially extending portion 76. The sleeve portion 72 is fastened to the link 60 of the actuating structure 50, via a fastener 78, so that the structure 50 and the shoe 70 are movable conjointly between the tool-disabling and tool-enabling positions.

The plate portion 74 has a first workpiece-contacting surface 80 and a second workpiece-contacting surface 82. The first workpiece-contacting surface 80 defines a plane, which is oriented at a right angle relative to the tool axis. The surface 82 merges with the surface 80 and defines a plane, which is oriented at a relatively large, acute (e.g. about 82°) relative to the tool axis and at a relatively small, acute (e.g. about 8°) relative to the plane defined by the surface 80. The radially extending portion 76 has a radial socket 90 opening inwardly, a radial bore 92 opening outwardly from the socket 90, and a shoulder 94, which is defined where the bore 92 meets the socket 90.

A wide tip 100 is provided, which has a stem 102 of circular cross-section extending rotatably into the bore 92, past the shoulder 94, into the socket 90. The stem 102 has a threaded socket 104 opening inwardly. A coiled spring 106 is disposed within the socket 90, around the stem 102, against the shoulder 94. A bolt 110 having a hex head 112, an integral washer 114, and a threaded stem 116 is provided. The stem 116 is threaded into the socket 104 so that the spring 106 is compressed partly but not fully between the washer 114 and the shoulder 94.

As shown in FIGS. 5 and 6, the extending portion 76 has two parallel, lateral surfaces 118 spaced by a given distance from each other. The tip 100 has two integral, parallel ribs 120 spaced by a slightly greater distance from each other, respectively on opposite sides of the stem 102. The surfaces 118 of the extending portion 76 fit slidably between the ribs 120 so as to prevent the tip 100 from rotating on the extending portion 76 unless the tip 100 is pulled outwardly against the spring 106, which thus is compressed further, for a sufficient distance for the ribs 120 to clear such portion 76. Thus, the tip 100 can be rotatably adjusted between a first adjusted position and a second adjusted position, as discussed below.

Figure 2:
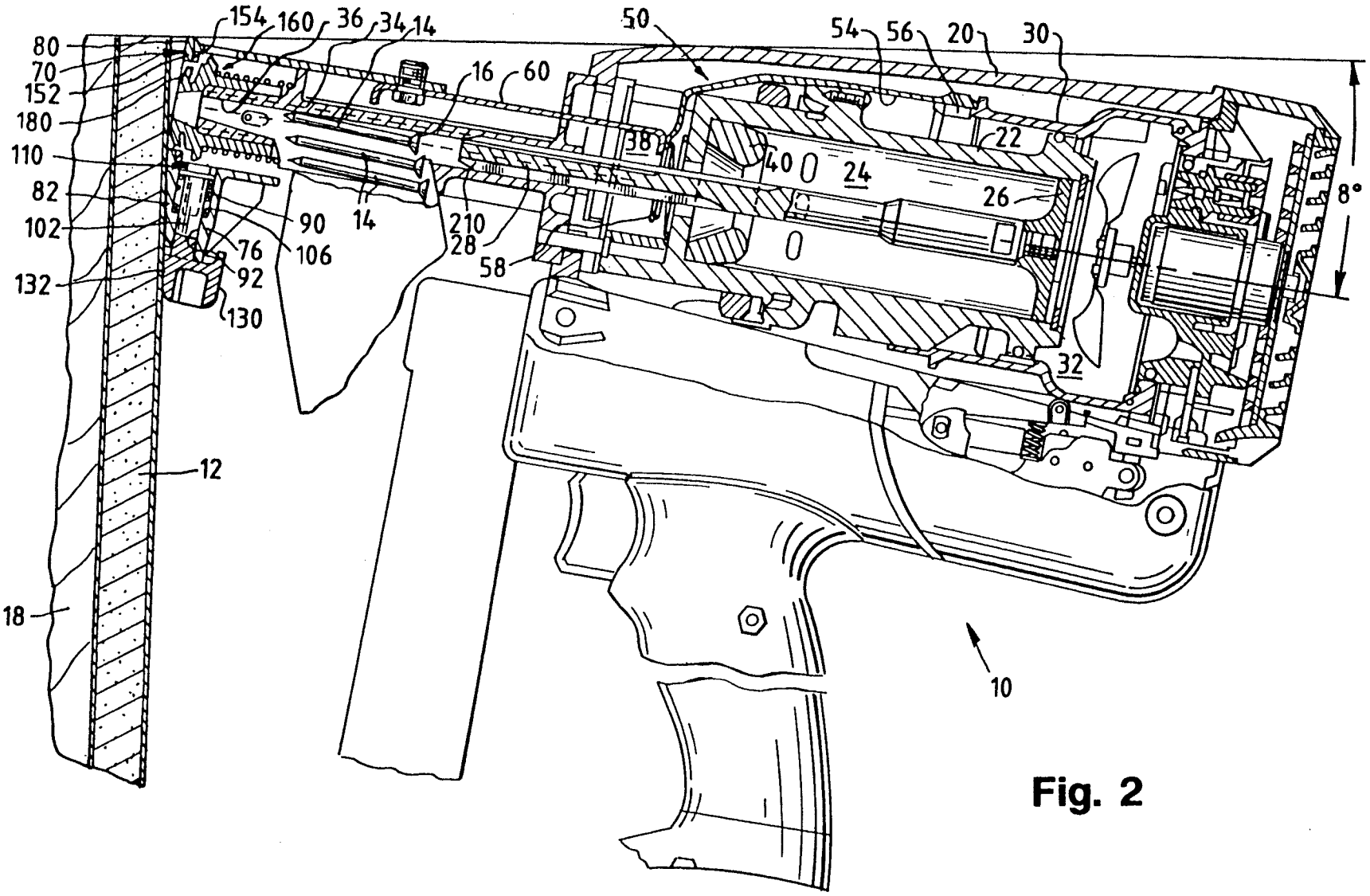
FIG. 2 shows the tool oriented to drive a nail as close as possible to a corner.
Figure 3:
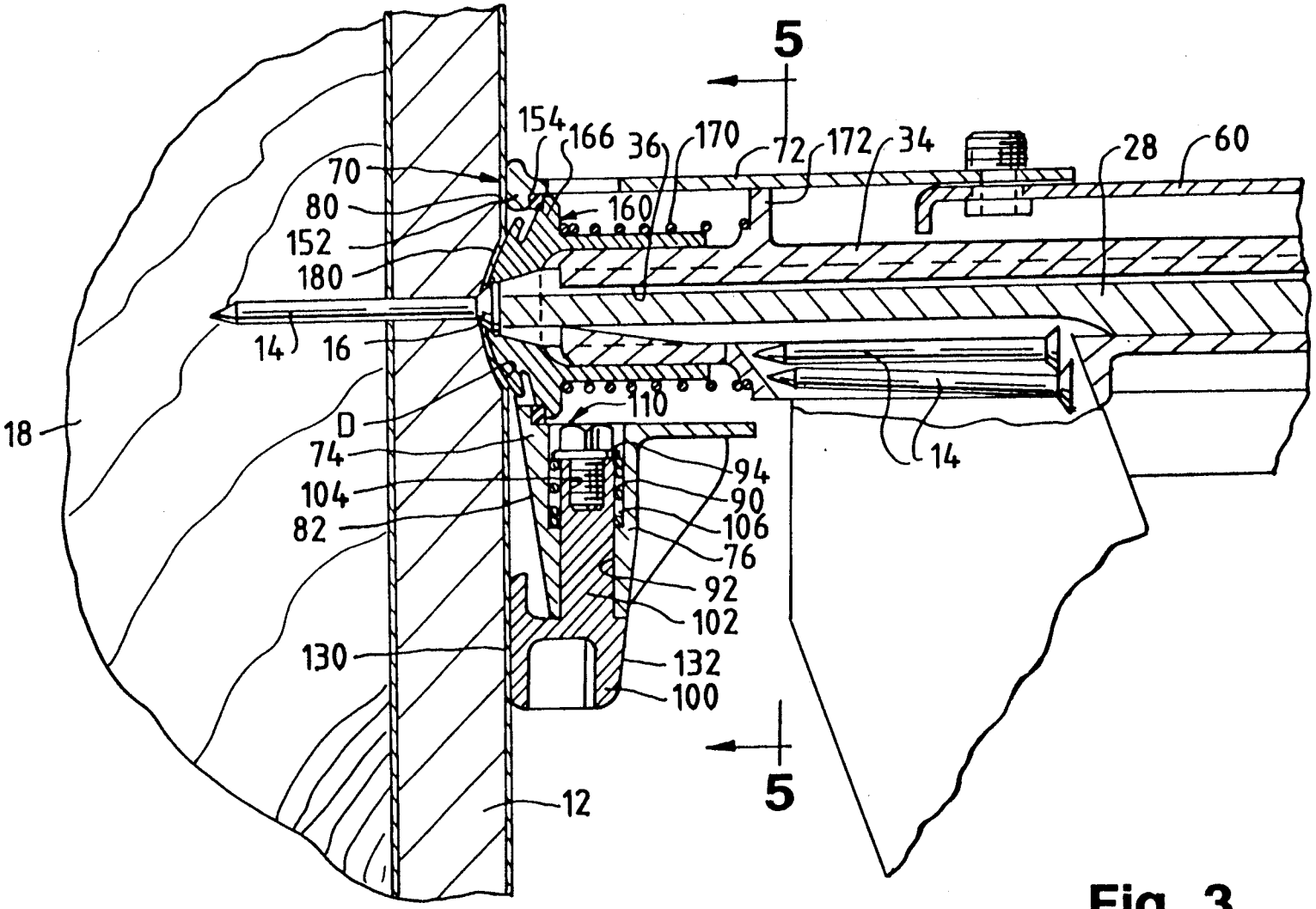
FIG. 3, on an enlarged scale, is a fragmentary detail of the tool, as shown in FIG. 1 except after a fastener has been driven and a dimple has been formed.
Figure 4:
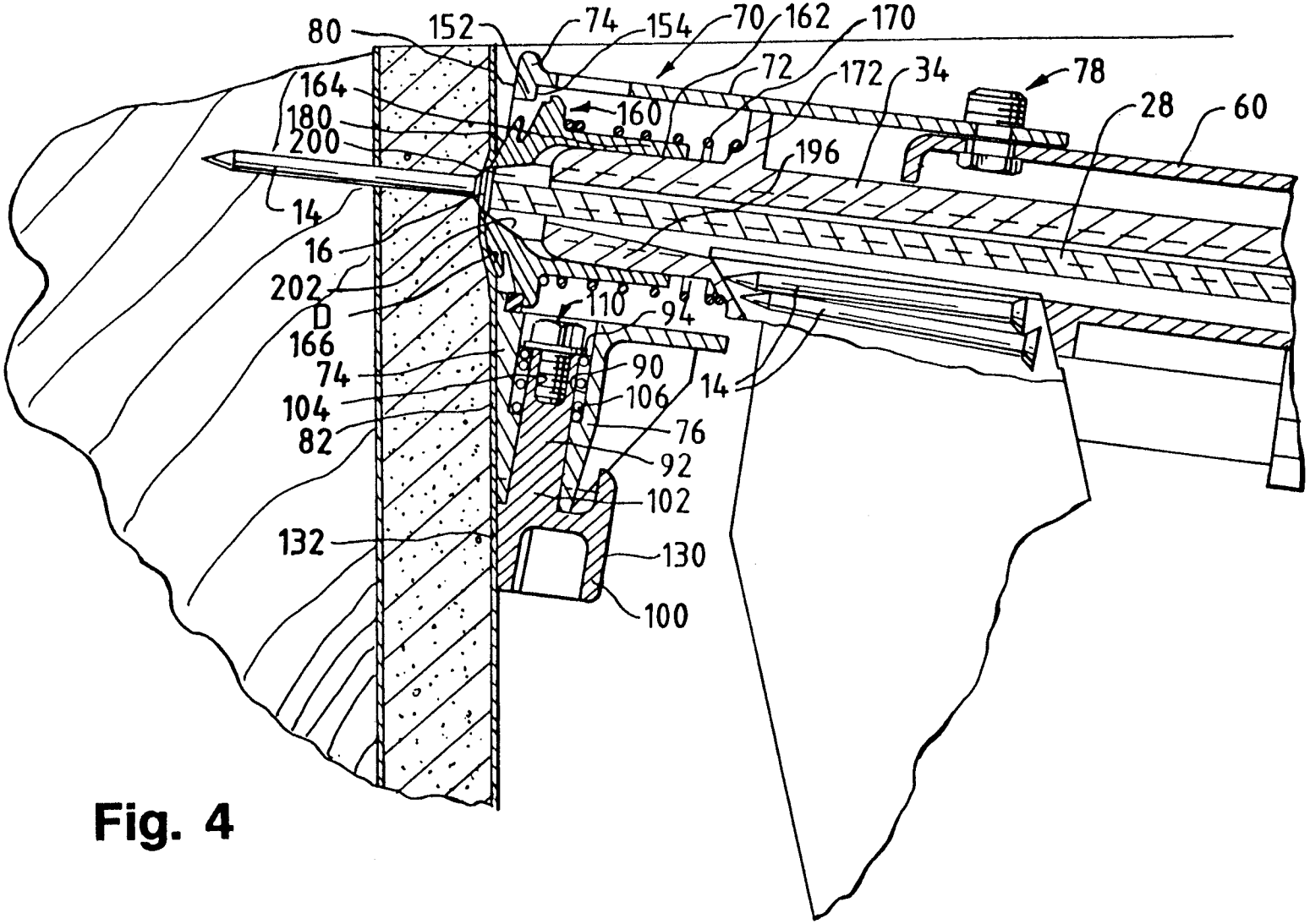
FIG. 4, on a similar scale, is a fragmentary detail of the tool, as shown in FIG. 2 except after a fastener has been driven and a dimple has been formed.

The tip 100 has a first workpiece-contacting surface 130 and a second workpiece-contacting surface 132. The tip 100 is configured so that the surface 130 is coplanar with the first workpiece-contacting 80 of the shoe 70 in the first adjusted position of the tip 100, as shown in FIGS. 1 and 3, and so that the surface 132 is coplanar with the second workpiece-contacting surface 82 of the shoe 70 in the second adjusted position of the tip 100, as shown in FIGS. 2 and 4.

With the tip 100 in the first adjusted position, in which the first workpiece-contacting surface 130 can lie flush against the drywall panel 12, the tip 100 is useful for orientating the tool 10 for driving a drywall nail 14 at a right angle relative to such panel 12. With the tip 100 in the second adjusted position, in which the second workpiece-contacting surface 132 can lie flush against the drywall panel 12, the tip 100 is useful for orienting the tool 10 for driving a drywall nail 14 at a relatively large, acute angle (e.g. 52°) relative to such panel 12. Because the housing structure 20 is bulky, the tool 10 can be much closer to the adjacent surface 140 if the tip 100 is in the second adjusted position than if the tip 100 is in the first adjusted position.

The tip 100 in either adjusted position, the shoe 70, and the actuating structure 50 are movable conjointly between the tool-disabling position and the tool-enabling position and are biased conjointly toward the tool-disabling position by the spring 52. The tip 100 and the shoe 70 can be firmly pressed against the drywall panel 12 so as to move the tip 100, the shoe 70, and the actuating structure 50 conjointly to the tool-enabling position, in which the tool 10 can be then operated (in a known manner) to drive a drywall nail 14.

As shown in FIG. 6 and other views, the shoe 70 has a large, circular aperture 150, which is defined by an annular rim 152. As shown in FIGS. 1 through 4, an annular bumper 154 made of a resilient material, such a synthetic rubber, is seated within the sleeve portion 72, against the annular rim 152.

A dimpler 160 is mounted to the nosepiece 34, within the sleeve portion 72 of the shoe 70, so as to be axially movable along an outer, cylindrical surface 162 of the nosepiece 34. The dimpler 160 has a sleeve portion 164 and an annular portion 166. The sleeve portion 164 defines a bore 168 coaxial with the bore 36 of the nosepiece 34. The sleeve portion 164 fits slidably over the such surface 162, whereby the dimpler 160 is movable outwardly and inwardly along the tool axis, over a limited range of relative movement between the dimpler 160 and the nosepiece 34.

The annular portion 166 is arranged to engage the annular bumper 154 so as to limit outward movement of the dimpler 160 relative thereto. A coiled spring 170 is disposed around the sleeve portion 164, between the annular portion 166 and a flanged portion 172 of the nosepiece 34, so as to bias the dimpler 160 outwardly along the nosepiece 34 but so as to permit the dimpler 160 to move inwardly along the nosepiece 34 when the shoe 70 and the tip 100 are pressed firmly against the drywall panel 12.

As shown in FIG. 6 and other views, the annular portion 166 has an convex, frusto-conical surface 180. Normally, as biased by the spring 170, the annular portion 166 extends axially beyond the shoe aperture 150 by a slight distance. When the shoe 70 and the tip 100 are pressed firmly against the drywall panel 12, the dimpler 160 is moved inwardly by a similar distance. Thereupon, as a drywall nail 14 is driven through the drywall panel 12, the dimpler 160 is driven so that the annular portion 166 forms a concave, frusto-conical dimple D in the drywall panel 12. The dimple D conforms generally to the surface 180.

As shown in FIG. 5, the nosepiece 34 has an elongate rail 190 extending along the bore 36. An inner, concave surface 192 of the rail 190 is arcuate in cross-section and conforms generally to the circular head 16 of a drywall nail 14. The driving blade 28 has an elongate slot 134 accommodating the rail 190, which fits slidably into the slot 134. The curved surface 192 guides the circular head 16 of each drywall nail 14 being driven by the tool 10. The driving blade 28 has an elongate, concave recess 194, which is arcuate in cross-section, in diametric opposition to the slot 134. The recess 194 enables the driving blade 28 to clear the drywall nail 14 positioned to be next driven.

As shown in FIGS. 1 through 4, where the nosepiece 34 has the cylindrical surface 162, the nosepiece 34 has a ramped ridge 196 extending along the bore 36. At each point along the ridge 196, the ridge 196 is arcuate in cross-section. At the distal end of the nosepiece 34, the ridge 196 conforms generally to the recess 194 so as to enable the driving blade 28 to clear the ridge 196. The ridge 196 helps to center each drywall nail 14 being driven through the bore 36. As shown in FIGS. 1 through 4, the annular portion 166 of the dimpler 160 has a socket 200 having a frusto-conical wall 202 narrowing toward the convex, frusto-conical surface 180. As shown therein and in FIG. 7, the driving blade 28 is formed at its distal end with a frusto-conical tip 210 conforming generally to the frusto-conical wall 202. The tip 210 fits into the socket 200 to drive the dimpler 160 outwardly when the piston 26 and the driving blade 28 are moved from the retracted position toward the advanced position. Thus, when the tool 10 is fired, a dimple D is formed in the drywall panel 12 while a drywall nail 14 is being driven through the drywall panel 12, where the dimple D is formed, into the wooden stud 18. Because the driving blade 28 engages the dimpler 160 at the frusto-conical tip 210, near the distal end of the driving blade 28, when the piston 26 and the driving blade 28 are moved from the retracted position toward the advanced position, it is not necessary to employ an elongate dimpler having a large mass, as in the Golsch and Fishback patents noted above. The impact between the piston 26 and the driving blade 28, as the driving mechanism of the tool 10, and the dimpler 166 is absorbed partly by the annular bumper 154 and is distributed by the shoe 70 over a broad area of the drywall panel 12. Thus, as compared to prior tools for similar use, the depth of penetration of the dimpler 160 into the drywall panel 12 can be more accurately controlled.

Various modifications may be made in the preferred embodiment described above without departing from the scope and spirit of this invention. Moreover, this invention is not limited to a combustion-powered, fastener-driving tool, as described above, but may be alternatively embodied in a pneumatically powered, fastener-driving tool, in which the piston and the driving blade are driven pneumatically.

What is claimed is:

1. A powered tool for dimpling a workpiece, and for driving an elongate fastener, through the workpiece into a substrate, the tool comprising (a) a housing structure defining a chamber having an axis and a nosepiece extending axially from the housing structure, the nosepiece having a bore coaxial with the chamber, the bore communicating with the chamber, (b) a dimpler mounted to the nosepiece so as to be outwardly and inwardly movable along the axis, over a limited range of relative movement between the dimpler and the nosepiece, the dimpler having an annular portion disposed axially beyond the nosepiece, the dimpler having a bore coaxial with the nosepiece bore, and (c) means including a piston movable axially within the chamber between a retracted position and an advanced position and a driving blade extending axially through the housing structure, the driving blade having a proximal end and a distal end and being joined to the piston at the proximal end so as to be conjointly movable with the piston between the retracted and advanced positions, for driving an elongate fastener through the bore of the nosepiece and through the bore of the annular portion of the dimpler, by engaging the annular portion of the dimpler with the distal end of the driving blade, and for driving the dimpler outwardly when the piston and the driving blade are moved from the retracted position toward the advanced position.

2. The tool of claim 1 wherein the dimpler is biased outwardly along the axis.

3. The tool of claim 1 wherein the driving blade is positionable to engage the annular portion of the dimpler after the distal end has moved through the bore of the nosepiece.

4. The tool of claim 1 further comprising means including a resilient bumper for limiting axial movement of the dimpler outwardly along the axis.

5. The tool of claim 1 further comprising means including a workpiece-contacting shoe movable axially between a tool-disabling position and a tool-enabling position and biased toward the tool-disabling position for disabling the tool unless the workpiece-contacting shoe is moved to the tool-enabling position.

6. The tool of claim 5 further comprising means including a resilient bumper mounted to the workpiece-contacting shoe for limiting axial movement of the dimpler outwardly along the axis.

7. The tool of claim 5 wherein the workpiece-contacting shoe has a first workpiece-contacting surface defining a plane oriented at a right angle relative to the axis and a second workpiece-contacting surface defining a plane oriented at a first acute angle relative to the axis and at a second acute angle relative to the plane defined by the first workpiece-contacting surface, the first acute angle being larger than the second acute angle, a tip being mounted adjustably to the shoe, the tip being adjustable between a first position and a second position, the tip having a workpiece-contacting surface coplanar with the first workpiece-contacting surface in the first position of the tip.

8. The tool of claim 7 wherein the tip also has a workpiece-contacting surface coplanar with the second workpiece-contacting surface in the second position of the tip.

9. The tool of claim 7 wherein the shoe has an extending portion and the tip is mounted to the extending portion so as to be rotatably adjustable between the first and second positions.

10. The tool of claim 1 wherein the annular portion of the dimpler has a socket having a frusto-conical wall and the driving blade at the distal end has a frusto-conical tip conforming generally to the frusto-conical wall, the driving blade tip fitting into the socket to drive the dimpler outwardly when the piston and the driving blade are moved from the retracted position toward the advanced position.

* * * * *